United States Patent [19]

Johnson

[11] Patent Number: 4,862,942

[45] Date of Patent: Sep. 5, 1989

[54] ROLLER WINDOW SCREEN

[76] Inventor: Lance A. Johnson, 520 Aragon Blvd., San Mateo, Calif. 94402

[21] Appl. No.: 161,789

[22] Filed: Feb. 29, 1988

[51] Int. Cl.[4] ..... A47H 1/00

[52] U.S. Cl. ..... 160/99; 160/27; 160/120

[58] Field of Search ..... 160/27, 30, 99, 100, 160/98, 23.1, 238, 120, 247, 28

[56] References Cited

U.S. PATENT DOCUMENTS

| | | | |
|---|---|---|---|
| 609,134 | 8/1898 | Beckwith | 160/30 |
| 1,164,385 | 12/1915 | Neupauer | 160/28 |
| 1,803,674 | 5/1931 | Nicholson | 160/99 |
| 2,323,295 | 7/1943 | Brewer | 160/99 |
| 2,361,762 | 10/1944 | Glenn et al. | 160/23.1 |
| 2,462,520 | 2/1949 | Marbach | 160/100 |
| 2,514,438 | 7/1950 | Bardega | 160/99 X |
| 2,553,868 | 5/1951 | Piva | 160/30 |
| 2,605,823 | 8/1952 | Lockhart | 160/30 |
| 2,825,400 | 3/1958 | Poulsen | 160/30 |
| 2,855,241 | 10/1958 | Walter | 160/23.1 X |
| 3,470,934 | 10/1969 | Agnew | 160/27 |
| 4,433,711 | 2/1984 | Lew | 160/120 |
| 4,597,430 | 7/1986 | Marguez | 160/23.1 X |
| 4,707,018 | 11/1987 | Gavagan | 160/23.1 X |

FOREIGN PATENT DOCUMENTS

| | | | |
|---|---|---|---|
| 1304727 | 1/1973 | United Kingdom | 160/238 |
| 1416431 | 12/1975 | United Kingdom | 160/23.1 |

*Primary Examiner*—Ramon S. Britts
*Assistant Examiner*—David M. Purol
*Attorney, Agent, or Firm*—Julian Caplan

[57] ABSTRACT

A window screen is attached to a sliding sash and to the sill. Fixed to the screen are two or more vertical bands of coil spring material. Thus when the sash is closed the springs cause the screen to coil tightly. As the sash is raised, the screen is uncoiled so that it covers the opening but remains taut. The coil may be located at the middle of opening or at the top. A housing integral with the sash end of the screen or surrounding the spring coil protects the coil from weather and debris.

12 Claims, 2 Drawing Sheets

ROLLER WINDOW SCREEN

BACKGROUND OF THE INVENTION

1. Field of the Invention

The invention relates to a window screen for sliding sash windows and is characterized by the fact that the screen rolls in a coil but does not require the use of spring wound rollers of the type used on conventional window shades. Strips of coil spring material are bonded to or extend along the surface of the screen and provide the force which winds the screen when the sash with which it is associated is lowered.

2. Description of Related Art

Heretofore, roller window screens have required mechanical interaction at their edges to manage their coiling and uncoiling. They have been propelled from without. Even a roller shade mechanism type, while physically occupying the core of the roll, requires an edge mounted bracket held in fixed relationship to the window-frame for its propulsion. There are many such prior structures shown in U.S. Pat. Nos. such as 609,134; 2,553,868, 2,605,823; 2,825,400 and 3,470,934. U.S. Pat. No. 1,164,383 shows tapes alongside the screen, but such tapes are for reinforcement and do not function as springs to rewind the screen. U.S. Pat. No. 2,462,520 shows perforated bands along the side edges of the screen which are wound and unwound by rowels on spring wound rollers attached to the window frame.

SUMMARY OF THE INVENTION

The present invention uses constant force springs which are relatively narrow as compared with the width of the window opening and are fixed for movement with a coil of window screen as it winds and unwinds. The structure hereinafter explained in detail has many advantages over prior roller screens.

One advantage of the invention is the fact that no permanent window covering is required in that the screen of the present invention deploys only in the area of the sash opening. No attachment to the window frame is required. Thus the undesirable consequences of standard fixed frame window screens are avoided, such disadvantages being the visual, functional and safety features thereof. Light transmission through existing windows is not impaired by light-dimming fixed screens.

Another advantage of the invention is the fact that normal motion of sash movement controls the opening and closing of the screen coil; when the window is closed, the screen system is also fully closed.

Another feature of the invention is the fact that the screen coil is inconspicuous and appears to the outside viewer as a small molded bead along the opening edge of the moving sash and the window sill of a double-hung window.

Still another feature of the invention is the fact that it enables householders to measure, fit and install the screen apparatus with a minimum of exact measurements and a maximum of on-site adjustment.

Another advantage of the invention is the fact that it has soft, flexible edges which, in the absence of any other mechanisms or brackets, conform to and tolerate the widest variety of side frame configurations.

Still another feature of the invention is that it provides the necessary function with a minimum of components. Moving parts and mechanisms are eliminated, thereby reducing the cost of production and increasing the longevity of the device.

Still another feature of the invention is that only components which are of weatherproof construction need be used and hence deterioration from rain, water, snow and the like is avoided.

Still another advantage of the invention is the fact that debris which may accumulate on the screen is discharged outwardly of the window in which the screen is installed, and does not fall into the interior of the room.

Other objects of the present invention will become apparent upon reading the following specification and referring to the accompanying drawings in which similar characters of reference represent corresponding parts in each of the several views.

DESCRIPTION OF PREFERRED EMBODIMENTS

Figure 1:
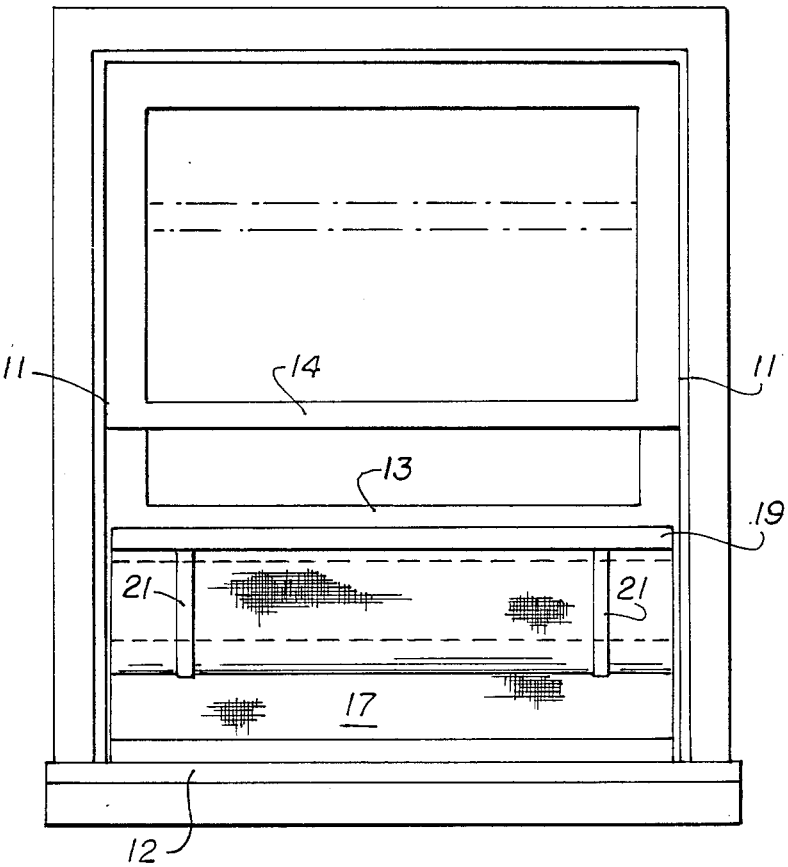
FIG. 1 is a front elevational view of a window in which the present invention is installed, the lower sash being partially opened.
Figure 4A:
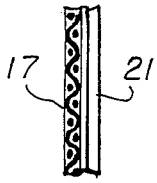
FIG. 4A is an enlarged section of a portion of FIG. 4.

The present invention is intended for installation in a window opening wherein there is a fixed frame containing one or more sliding sash elements. The drawings and this specification disclose embodiments of the invention in a double-hung window. FIG. 1 shows side frame members 11, a bottom sill 12, and vertically sliding bottom and top sashes 13 and 14, respectively. Although the screens hereinafter described may be installed in either the bottom or top sash or both, only bottom sash installation is herein illustrated and hereinafter described.

Figure 2A:
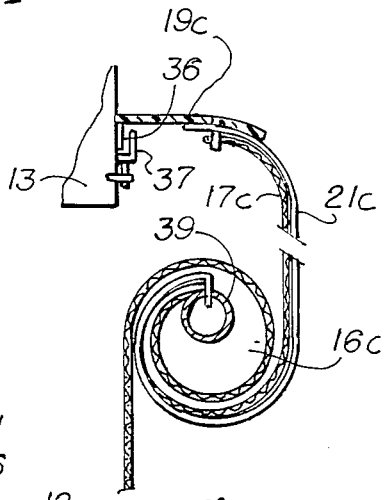
FIG. 2A is a partial sectional view showing a modification of the structure of FIG. 2.
Figure 2:
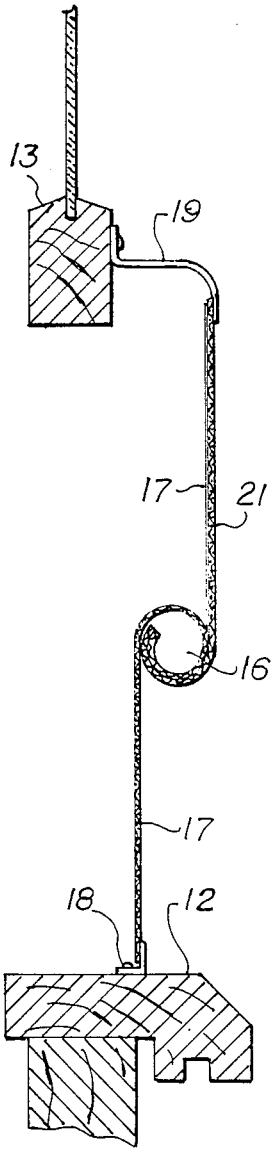
FIG. 2 is a somewhat schematic vertical sectional view through the structure of FIG. 1.

In the modification of FIG. 1, a coil 16 of conventional flexible screen 17 is shown in FIGS. 1 and 2 in mid-position between the open sash 13 and the sill 12. The lower end of screen 17 is attached to the sill 12 by attachment 18 in the shape of an angle bar. The upper end of screen 17 is attached to the lower edge of sash 13 by means of a reverse curve flexible plastic (or other light-weight sheet material) member 19, the upper edge of the screen 17 being fixed to the lower edge of the attachment 19 by any convenient means.

Figure 3:
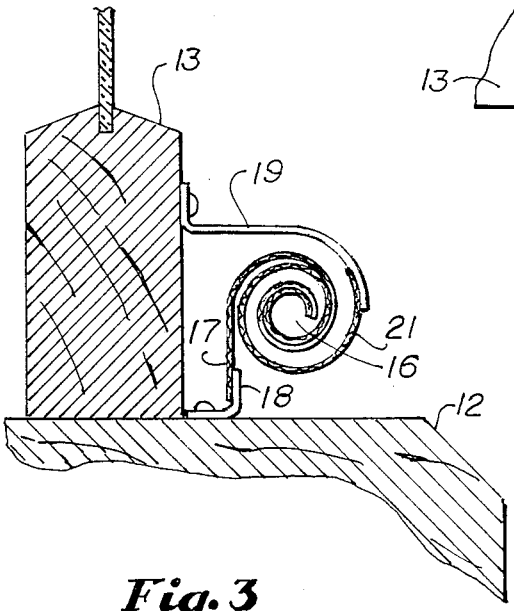
FIG. 3 is a view similar to FIG. 2 showing the position of the screen when the sash is fully closed.

As best shown in FIGS. 1 and 3, narrow coil spring strips 21 are attached by any convenient means such as a silicone adhesive tq the screen 17, the upper ends of the spring strips being attached to the lower end of the attachment 19. Various types of constant force springs may be used, preferably made of stainless steel. Conventionally such strip springs are many times of laminated construction. A suitable spring is Catalog No. CF015-0050 of SPEC Associated Spring Division of Barnes Group, Inc., having a thickness of 0.004 inches and a width of approximately one-quarter inch. It will be understood that other springs may be substituted.

In the use of the device, when the sash 13 is down, the screen assumes the position shown in FIG. 3. The attachment 19, for practical purposes, shields the coil 16 from view and protects it from direct exposure to weather. When the sash is raised to the position of FIG. 2, the tension of the spring retains the coil 16 in approximately its original shape, except that the upper end, which is attached to attachment 19, is extended and the lower portion, which is attached to attachment 18 is likewise extended, leaving the coil in approximately the middle of the opening between the sash and the sill. The length of the spring strips 21 is sufficient so that the sash 13 may be fully opened. For such purpose, the length of the strips 21 is approximately one-half the distance between the sash 13 and sill 12 in full opened position. When the sash 13 is closed, the spring strips 21 tend to return to their original position of FIG. 3, causing the coil 16 to wind upon itself, maintaining the screen 17 taut at all times.

Installation of the device of FIGS. 1–3 is readily apparent. The attachments 18 and 19 and the width of the screen coil 17 are cut to the distance between the vertical frame members 11. Such operation is easily accomplished with conventional household tools since the invention involves no structure or mechanisms at its edges. Thus the screen material may be removed as necessary without affecting the operation of the invention in any way. The attachments 18 and 19 are then connected to the sill 12 and sash 13, respectively, thereby completing the installation.

In the modification of FIG. 2A, housing **19*c* has a down-turned flange 36 which is attached to sash 13 by clip 37. Stiffener tube 39 inside coil 16*c* is preferably of plastic or aluminum or other light-weight material and stiffens the structure, transmitting the rotational force of springs 21*c* laterally throughout the screen body 17*c***. It provides a light-weight resistance to bending and twisting. Although preferably round, it may be triangular or other shape.

Figure 4:
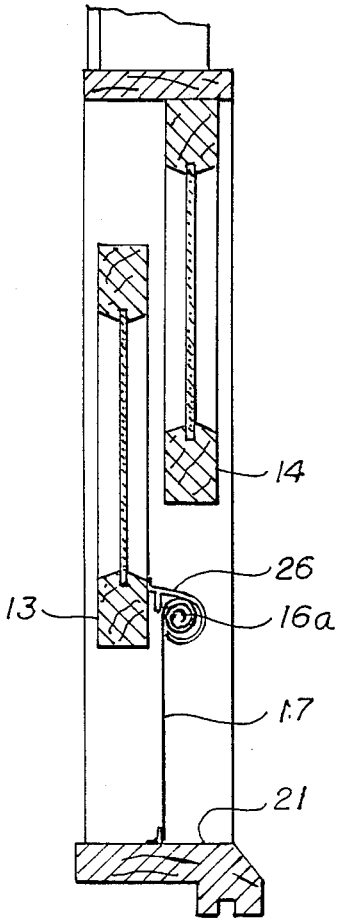
FIG. 4 is a view similar to FIG. 2 of a modification.

In the modification of FIG. 4, housing 27 is attached to the sash 13 sufficiently high so that the attachment 26 is totally above the bottom edge of the sash 13. The screen coil **16*a* is completely within the housing 26 and the stop 27 prevents the coil from escaping from the housing. It will be seen that the housing 26 is approximately J-shaped in order to accomplish this result. Coil 16*a* is attached to sill 12 by fitting 18. However, the upper edge of screen 17*a* is not attached to fitting 26 or to sash 13. In other words, coil 16*a* is freely turnable inside housing 26**.

Figure 5:
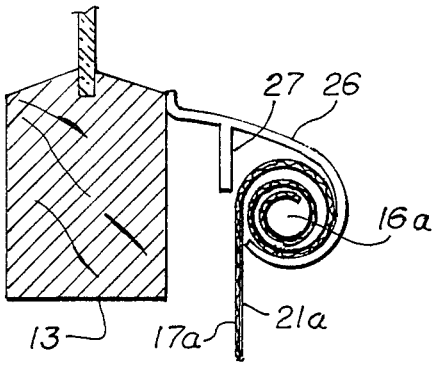
FIG. 5 is an enlarged, somewhat schematic view of the structure of FIG. 4.

In the use of the device of FIGS. 4 and 5, the coil **16*a* remains at all times within the housing 26**.

Figure 6:
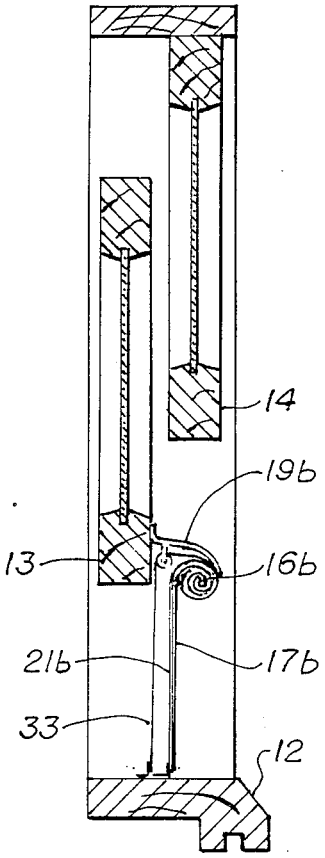
FIG. 6 is a view similar to FIG. 4 of still another modification.
Figure 7:
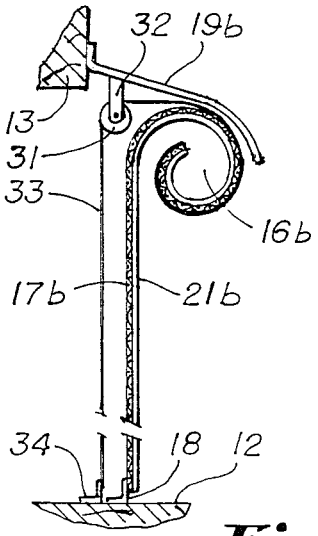
FIG. 7 is an enlarged somewhat schematic view similar to FIG. 2 of the modification of FIG. 6.

In the form of the invention shown in FIGS. 6 and 7, the general shape of the attachment **19*b* resembles that of FIG. 1. A roller 31 is rotatably supported from the attachment 19 by bracket arms 32. In addition to the spring coil strips 21*b*, two thin tapes 33 of Mylar or similar material parallel to the spring strips 21*b* are located toward the edges of the screen roll. The strips 21*b* and tapes 33 pass over the roller 31 and are connected at their bottom edges by attachment 34 to the sill 21. The embodiment of FIGS. 6 and 7 resembles in operation that of FIGS. 4 and 5**.

In the modification of FIGS. 4–5 and 6–7 and 2A, many of the elements of the structure are identical to those of FIGS. 1–3 and the same reference numerals followed by the subscripts a, b, and c, respectively, identify corresponding parts.

What is claimed is:

1. A window screen assembly in combination with a sliding sash window slidable in a frame, said frame having sides and a sill, said screen assembly comprising a screen having a width approximately the distance between the sides of the frame capable of being coiled in a coil, first means for securing a first edge of said screen to move with the window sash, second means for attaching a second edge of said screen to the sill, and at least one coil spring formed of flat material attached to a portion of said screen and extending and retracting in a direction parallel to said sides, whereby said spring biases said screen into a coil and said spring unwinds as said first edge of said screen is moved away from said second edge of said screen, said screen assembly being entirely separated from said sides of said frame.

2. A screen according to claim 1 in which when said sash is open said coil is approximately midway between said sash and said sill.

3. A screen according to claim 1 in which the first edge of said screen is fixed relative to said sash.

4. A screen according to claim 1 in which said first means is a housing shaped to receive said coil and said coil is free to rotate within its first means.

5. A screen according to claim 4 in which said first means is fixed to said sash and curls downward-outward and then inward-upward and which further comprises a stop extending substantially straight downward to retain said coil within said housing.

6. A screen according to claim 4 in which said first means further comprises roller supported in said housing, a tape coiled within said spring when said screen is coiled in a screen coil alongside said spring and extending over said roller and down to said sill and means securing the lower end of said tape to said sill.

7. A screen according to claim 1 which further comprises a plurality of narrow coil springs, at least one said spring on each side of said screen.

8. A screen according to claim 7 in which said coil springs are spaced inward from the edges of said screen.

9. A screen according to claim 3 in which said coil springs extend upward from said coil to said first means.

10. A screen according to claim 1 in which said screen coil is formed with a reverse bend and said spring extends from one end of said screen only to said reverse bend.

11. A screen according to claim 10 which further comprises a transverse stiffener tube within said screen coil adjacent said reverse bend, an end of said spring being fixed to said tube.

12. A screen according to claim 11 in which said reverse bend is clamped between said end of said spring and said tube.

* * * * *